US005456478A

United States Patent [19]

Hsu et al.

[11] Patent Number: 5,456,478

[45] Date of Patent: Oct. 10, 1995

[54] ROLLER SKATING SHOES WITH A LIGHT EMITTING DEVICE

[76] Inventors: Chi-Hsueh Hsu; Chih-Yes Shyu; Jong-Yes Shyu, all of 4F, No. 144, Chu-Lin Road, Yung-Ho Shih, Taipei Hsien, Taiwan

[21] Appl. No.: 229,708

[22] Filed: Apr. 19, 1994

[51] Int. Cl.[6] ..... A63C 17/06

[52] U.S. Cl. ..... 280/11.22; 280/811; 362/78; 362/192

[58] Field of Search ..... 362/72, 78, 192; 280/809, 811, 11.19, 11.22

[56] References Cited

U.S. PATENT DOCUMENTS

| | | | |
|---|---|---|---|
| 2,505,154 | 4/1950 | Smith | 280/11.22 X |
| 2,931,012 | 3/1960 | Kosach | 362/78 X |
| 3,789,208 | 1/1974 | Lewis | 362/78 X |
| 4,135,229 | 1/1979 | Modurkay | 362/78 X |
| 4,648,610 | 3/1987 | Hegyi | 362/192 X |
| 4,782,431 | 11/1988 | Park | 362/192 X |
| 5,257,795 | 11/1993 | Babcock | 280/11.22 X |

*Primary Examiner*—Richard M. Camby
*Assistant Examiner*—Michael Mar
*Attorney, Agent, or Firm*—Morton J. Rosenberg; David I. Klein

[57] ABSTRACT

A roller skating shoe with a light emitting device includes an elongate inverted U-shaped plate fixed under a skating shoe, a plurality of rollers combined rotatably with the elongate inverted U-shaped plate by means of two locating plates and bearings and rod shafts passing through the inverted U-shaped plate, the locating plates, and the rollers to be tightly screwed with anti-loose nuts. Coils are electrically connected with light emitters fixed on both sides of each roller. Magnets are fixed on the two locating plates producing magnetism to cross each coil to allow the coil to produce electricity to light up each emitter when the rollers are rotated by a skater.

1 Claim, 4 Drawing Sheets

ROLLER SKATING SHOES WITH A LIGHT EMITTING DEVICE

BACKGROUND OF THE INVENTION

Common roller skating shoes are used only to roll to move on the ground for a user to skate. They roll very quickly with no warning device, having latent danger to collide with other skaters, especially in the night.

SUMMARY OF THE INVENTION

This invention has been devised to offer a kind of roller skating shoe with a light emitting device to give warning by lighting up light emitters provided on rollers while it is used to roll on the ground skating.

The light emitters are electrically connected with related coils mounted on the rollers, and magnets are mounted on two elongate locating plates fixed on both sides of each roller on the inner sides of an elongate inverted U-shaped plate fixed under a skating shoe. Electric current is induced in each coil as it is caused to cross the magnetic field of a magnet when the rollers rotate.

BRIEF DESCRIPTION OF DRAWINGS

The invention will be better understood by reference to the accompanying drawings, wherein.

DESCRIPTION OF PREFERRED EMBODIMENTS

Figure 1:
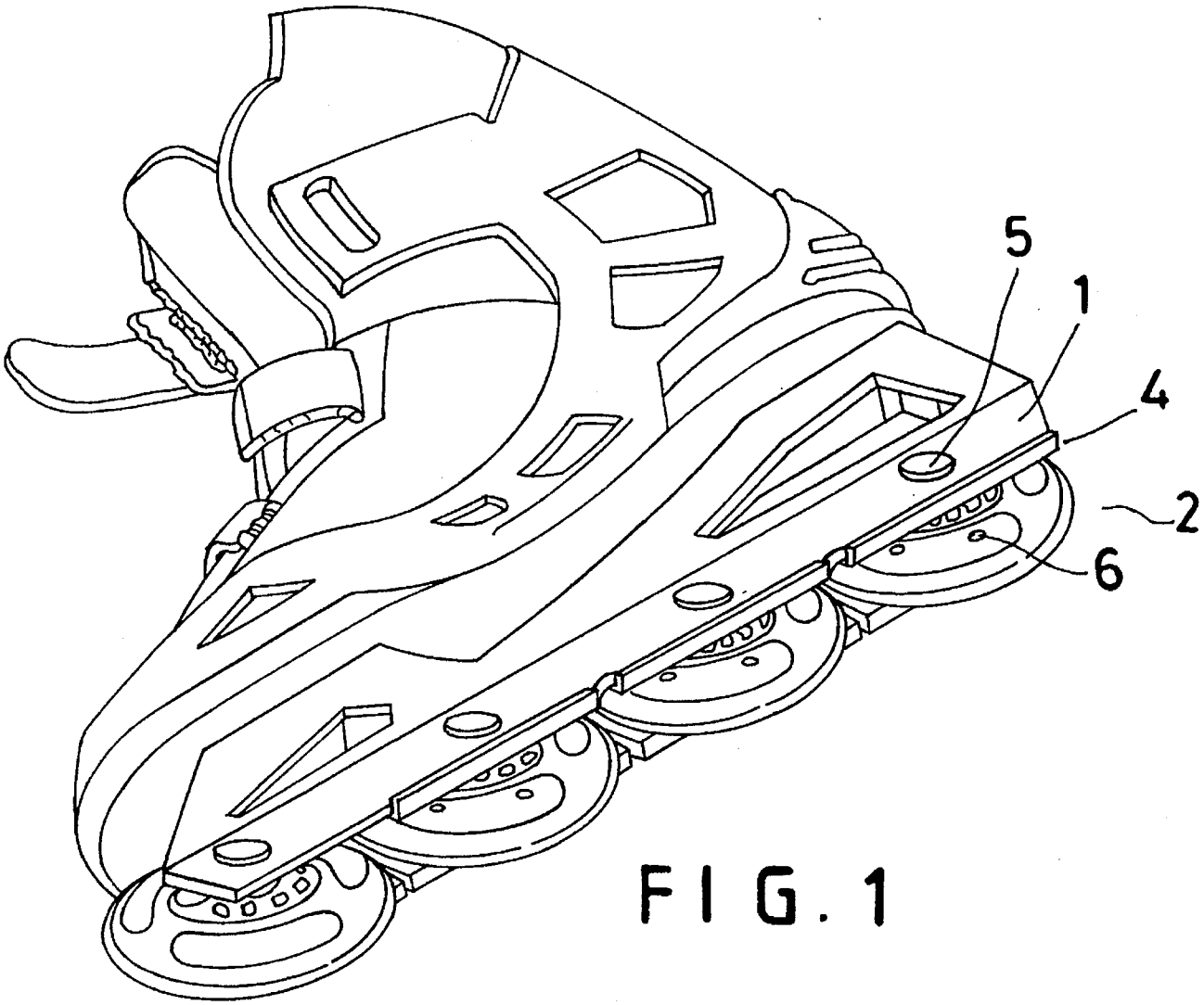
FIG. 1 is a perspective view of a roller skating shoe in the present invention.
Figure 2:
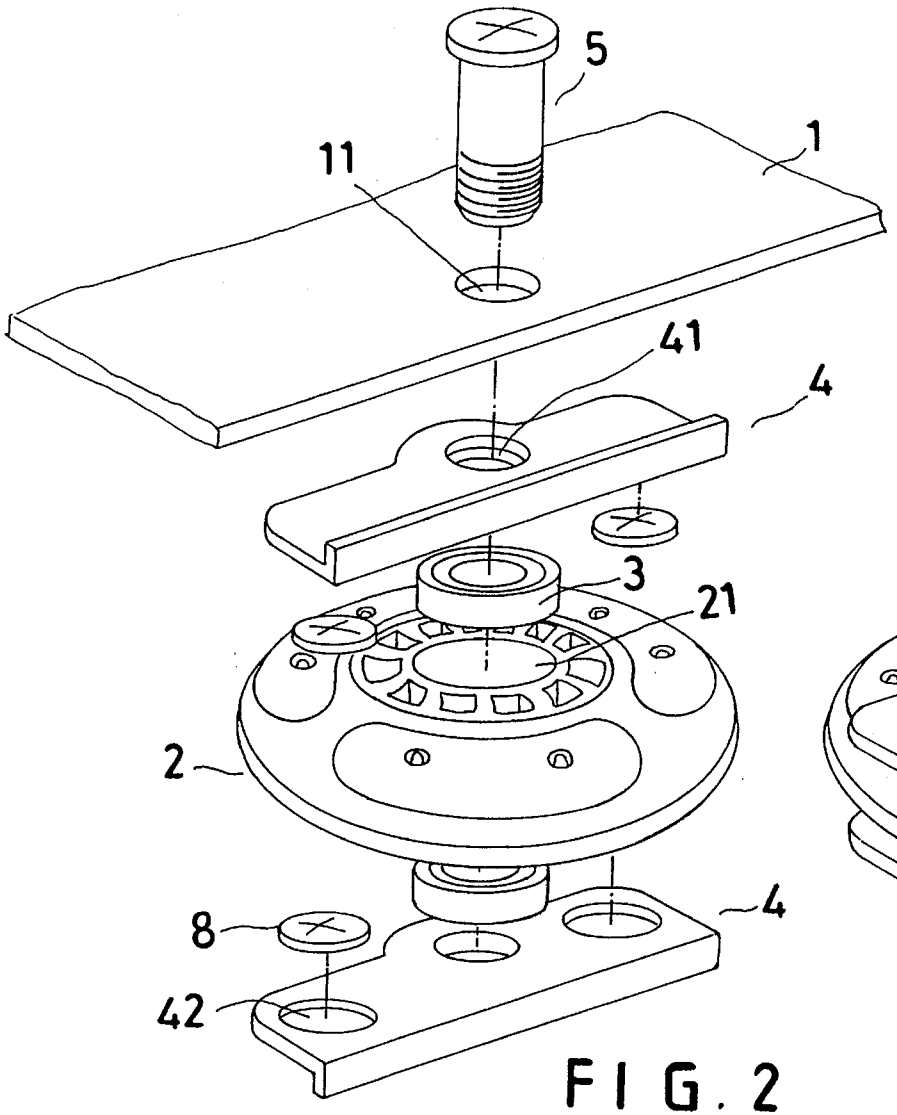
FIG. 2 is an exploded perspective view of the roller skating shoe in the present invention.

A roller skating shoe with a light emitting device in the present invention, as shown in FIGS. 1 and 2, includes an elongate inverted U-shaped plate 1, a plurality of rollers 2, a plurality of bearings 3, two locating plates 4, 4, a plurality of threaded rod shafts 5, a plurality of light emitters 6, a plurality of coils 7 and a plurality of magnets 8 combined together.

Figure 3:
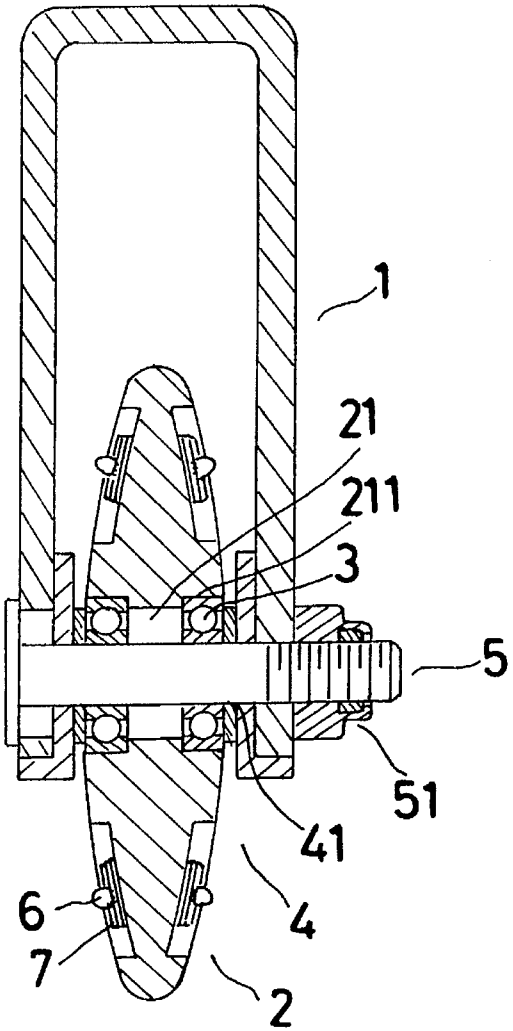
FIG. 3 is a front cross-sectional view of the roller skating shoe in the present invention.

The elongate inverted U-shaped plate 1, as shown in FIG. 3, is U-shaped in its cross-section, being fixed under the sole of a roller skating shoe for supporting the plurality of rollers 2, and having a plurality of shaft holes 11 for the threaded rod shafts 5 to pass through.

Each of the rollers 2 has a center shaft hole 21 and two annular recesses 211 around both sides of the center shaft hole 21 for the outer circumference of the bearing 3 to fit therein. Then the bearings 3 sustain a shaft rod 5, enabling each roller 2 to rotate about the rod shaft 5.

Figure 4:
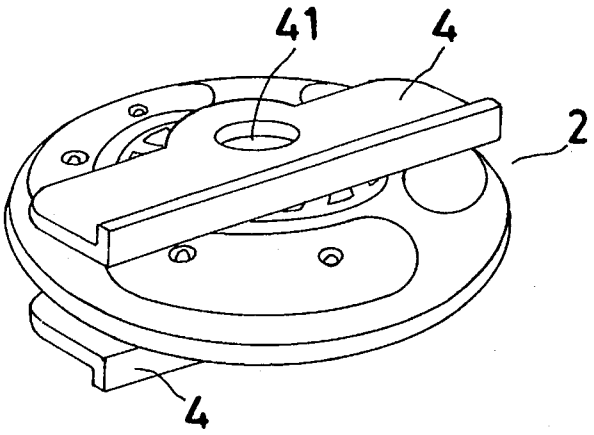
FIG. 4 is a perspective view of the roller combined with two locating plates fixed on both sides of the rollers in the present invention.
Figure 6:
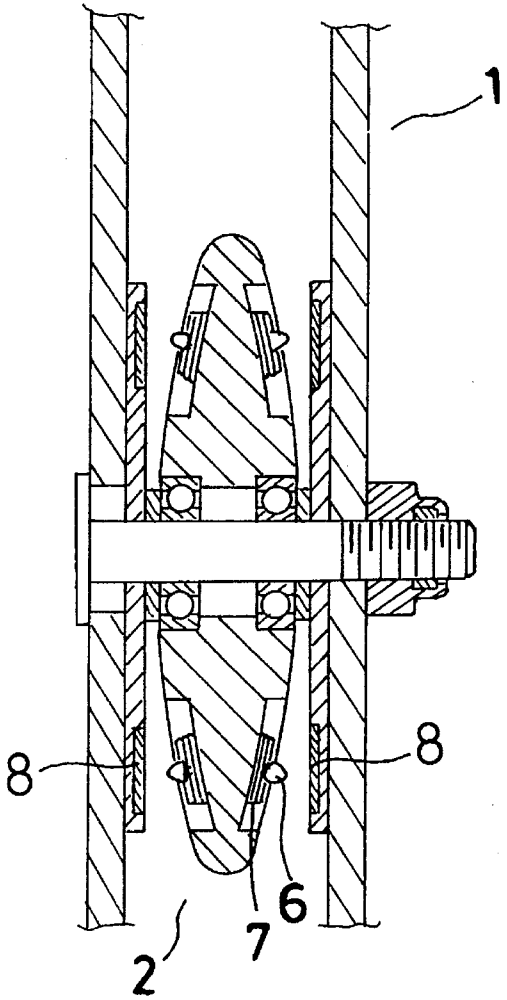

The L-shaped elongated locating plate 4 has a plurality of round recesses 42 and shaft holes, and a pair of the L-shaped elongate locating plates 4, 4" are combined with an inner side of two lower longitudinal portions of the elongate inverted U-shaped plate 1 as shown in FIGS. 3, 4 and 6. Each threaded rod shaft 5 passes through a shaft hole 11 of the elongate inverted U-shaped plate 1, the center shaft hole 11 of each roller 2 and a shaft hole 41 of the locating plates 4, 4 and two bearings 3, 3, and then tightly engages with an anti-loose nut 51 so as to sustain each roller 2 in its rotatable position.

Figure 5:
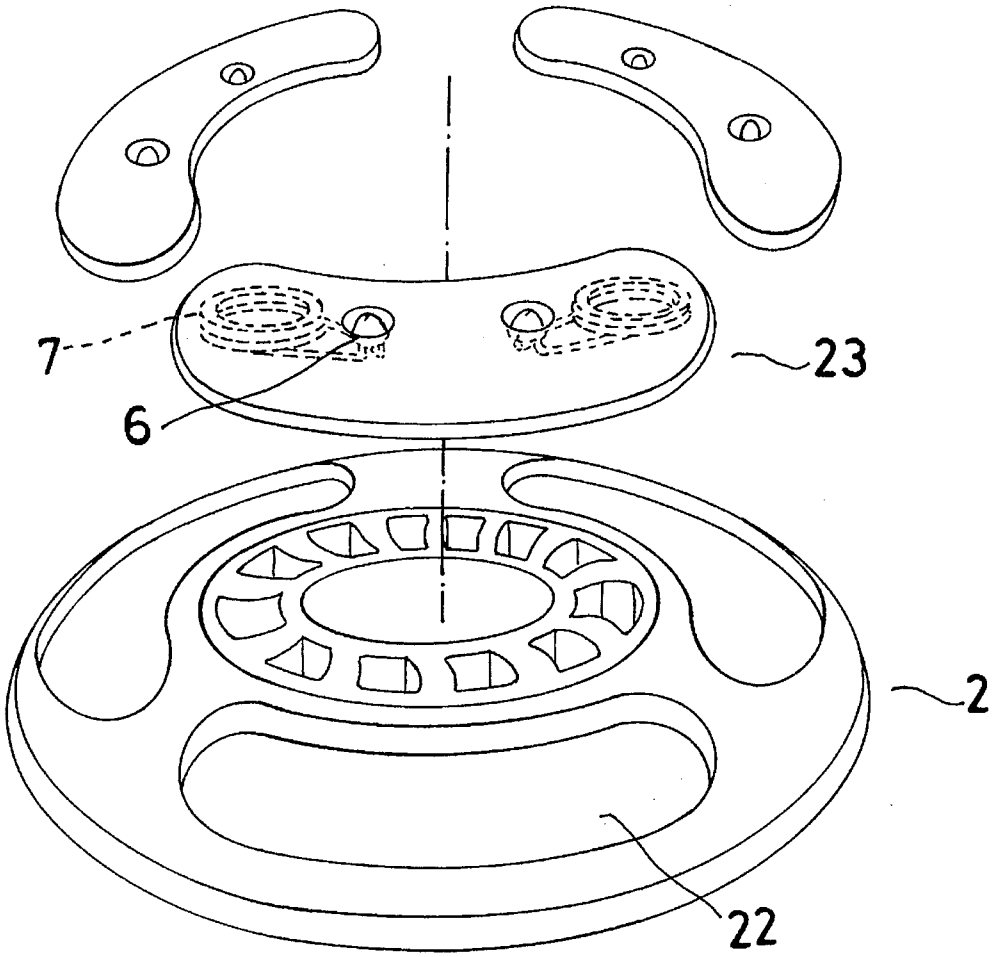
FIG. 5 is a perspective view of the roller fixed with fitting plates in the present invention; and, FIG. 6 is an upside cross-sectional view of the roller skating shoe in the present invention.

The feature of this invention is that each roller 2 is provided with a plurality of openings 22 spaced around the center hole 21 between the center hole 21 and its outer circumference for fitting plates 23 of the same shape as the opening 22 to fit therein, as shown in FIG. 5. And each fitting plate 23 has a plurality of light emitters 6 electrically connected with a coil 7 also provided thereon. In addition, a plurality of round flat magnets 8 are fitted in the round recesses 42 of the locating plates 4, 4.

In operation, as shown in FIG. 6, as the rollers 2 roll on the ground, each coil 7 sequentially crosses the magnetic field of a magnet 8. Electric current is then sequentially induced in each coil 7 to power up and light up each related light emitter 6. So while this skating shoe is used for skating, the light emitters around the rollers emit light to give warning, especially brightly in the night.

The present invention has advantages that conventional roller skating shoes do not have as listed below.

1. The light emitters can emit light, especially brightly in the night, while a user is skating with these shoes.
2. It is convenient to self-producing electricity to light up the emitters, without necessitating the use of batteries.
3. Lighting of the emitters during skating gives additional feeling of beauty as well as warning.

While the preferred embodiments of the invention have been described above, it will be recognized and understood that various modifications may be made therein and the appended claims are intended to cover all such modification which may fall within the spirit and scope of the invention.

What is claimed is:

1. A roller skating shoe with a light emitting device comprising:

an elongate inverted U-shaped plate being fixed under a skating shoe, having a plurality of shaft holes;

a plurality of rollers being mounted within said elongate inverted U-shaped plate and with corresponding pairs of elongate locating plates by means of bearings and rod shafts, for rolling movement on the ground for skating;

each said pair of elongate locating plates being longitudinally extending and respectively fixed at both sides of each one of said rollers and on two inner sides of two longitudinal lower portions of said elongate inverted U-shaped plate by means of the rod shafts passing through shaft holes thereof and said shaft holes of said inverted U-shaped plate and center shaft holes of said rollers and bearings deposited in said shaft holes of said rollers;

a plurality of rod shafts provided to pass through said shaft holes of said elongate inverted U-shaped plate and of said locating plates and of said rollers and sustained by said bearings in said rollers, each rod shaft being screwed tightly with anti-loose nuts for sustaining and enabling said rollers to rotate freely;

a plurality of light emitters provided in a plurality of fitting plates fitted in a plurality of openings formed in each of said rollers;

a plurality of electric coils fixed on said fitting plates, each coil being located beside a related said light emitter and circumferentially spaced therefrom and connected electrically with each other thereto;

a plurality of round flat magnets fitted tightly in longitudinally spaced round recesses formed in each one of said pairs of locating plates; and, each said coil producing an electric current when the coil is moved across a magnetic field of each said magnet, thereby powering and lighting up each related said emitter during rotation of said rollers.

* * * * *